United States Patent [19]

Lamers et al.

[11] 4,248,298

[45] Feb. 3, 1981

[54] WELL LOGGING EVAPORATIVE THERMAL PROTECTION SYSTEM

[75] Inventors: Michael D. Lamers, Palos Verdes Estates; Vincent P. Martelli, Rancho Palos Verdes, both of Calif.

[73] Assignee: Measurement Analysis Corporation, Torrance, Calif.

[21] Appl. No.: 13,544

[22] Filed: Feb. 21, 1979

[51] Int. Cl.[3] ..... E21B 47/00; F25D 17/02; F25D 23/12

[52] U.S. Cl. ..... 166/57; 62/259 A; 138/111; 138/134; 166/302

[58] Field of Search ..... 62/259 A, 260, 331, 62/514 R, DIG. 12; 138/111, 112, 130, 131, 134, 135; 250/261; 166/57, 302, 288, 250

[56] References Cited

U.S. PATENT DOCUMENTS

| | | | |
|---|---|---|---|
| 1,980,426 | 11/1934 | Noyes | 138/135 X |
| 2,671,323 | 3/1954 | Richert | 62/259 |
| 2,711,084 | 6/1955 | Bergan | 62/259 |
| 3,049,620 | 8/1962 | George et al. | 250/261 |
| 3,138,337 | 5/1967 | Bauer | 138/134 X |
| 3,167,653 | 1/1965 | Rumble et al. | 250/261 |
| 3,435,629 | 4/1969 | Hallenburg | 62/259 |
| 3,488,970 | 1/1970 | Hallenburg | 62/259 X |
| 3,499,668 | 3/1970 | Cullen et al. | 138/134 X |
| 3,526,086 | 9/1970 | Morgan | 138/111 |
| 3,853,149 | 12/1974 | Stine | 138/111 |

*Primary Examiner*—Stephen J. Novosad
*Attorney, Agent, or Firm*—John Holtrichter, Jr.

[57] ABSTRACT

An evaporative thermal protection system for use in hostile environment well logging applications, the system including a downhole thermal protection cartridge disposed within a well logging sonde or tool to keep a payload such as sensors and support electronics cool, the cartridge carrying either an active evaporative system for refrigeration or a passive evaporative system, both exhausting to the surface through an armored flexible fluidic communication mechanical cable.

12 Claims, 5 Drawing Figures

WELL LOGGING EVAPORATIVE THERMAL PROTECTION SYSTEM

BACKGROUND OF THE INVENTION

The background of the invention will be set forth in two parts.

1. Field of the Invention

This invention relates to well logging and more particularly to protection systems for keeping a sonde-located payload cool for an extended period of time.

2. Description of the Prior Art

The high temperature caustic hostile environment associated with geothermal walls has placed severe limitations on the use of existing petrophysical well logging techniques and tools in exploration, reservoir assesment and operation of geothermal energy systems. Also, these same well logging limitations are being experienced in very deep oil and gas wells and in wells involving steam injection recovery. An example of a well logging tool is an instrument package, generally known as a sonde, which is lowered into a borehole to make measurements.

The downhole well temperatures being experienced in geothermal energy systems range from less than 200 degrees centigrade to above 370 degrees centigrade. The availability of materials required for these logging tools such as sensors, seals, electronics, wire insulation, fluids and lubricants, motors, potting, adhesives, etc., diminishes exponentially at temperatures above about 200 degrees centigrade.

There are only a very limited number of commercial sources for sensors and electronics which can operate up to about 200 degrees centigrade, while there are numerous commercial sources for sensors and electronics which can operate up to 125 degrees centigrade. Accordingly, the design technique currently employed by most logging tool developers for operation at these high temperatures is to package the electonic circuitry and devices within a passive superinsulated cartridge (dewar).

The dewar typically consists of a metal or glass vacuum bottle which also may contain additional heat sink material inside. By using this dewar/heat sink approach, the temperature rise time within the dewar is minimized, permitting the logging tools to 'get in and out' of the well before the payload operating temperature limits are exceeded. For example, in a 275 degree C. downhole environment, this approach provides thermal protection for 4 to 10 hours with much shorter times for higher temperatures.

The exposure time for a passive thermal protection system is governed by the following: (1) operating temperature differential between the payload and well fluid; (2) the thermal conductivity and size of the superinsulated cartridge; (3) the internal heat dissipation of the payload; and (4) the thermal mass/heat sink capacity within the container.

In an attempt to enhance the exposure time, many novel techniques have been developed to maximize the thermal mass/heat sink capacity within the container by disposing in the superinsulated container a material having high thermal capacity. The thermal capacity designs typically employ the technique of raising the temperature of a solid and/or a liquid material having a high specific heat and/or heat of fusion and/or high heat of vaporization. Typical examples of well logging systems utilizing these techniques are disclosed in such U.S. Pat. Nos. 2,711,084; 2,824,233; 3,038,074; 3,049,620; 3,167,653; and 3,702,932.

In order to maximize the thermal capacity of a given material, refrigeration systems have been designed to cool the thermal mass and payload prior to lowering the tool into the well. An example of this technique is described, for example, in the above-noted U.S. Pat. Nos. 2,711,0084 and 3,167,653. Typically, the most effective of these passive thermal protection systems rely on the high heat of fusion or vaporization of the thermal mass together with some amount of specific heat absorption from the temperature rise of the material prior to and/or after phase transition.

A major limitation in systems employing the heat of vaporization concept is the limited low pressure volume available for storing the vaporized fluid unless the well pressure is lower than the vaporization pressure wherein it can be exhausted directly into the well. This is described in the previously cited U.S. Pat. No. 3,049,620. Unfortunately, for geothermal and deep oil and gas wells, the well pressures are very high (i.e., 400 psi to greater than 10,000 psi) and the vaporization pressure for practical high heat capacity materials are below 400 psi.

To overcome these exposure time limitations of prior art passive thermal protection systems, several active systems employing downhole motor-driven compressors have been designed to compress a vaporizing fluid, as typically described in U.S. Pat. No. 3,435,629 and in a project being performed by Jun Fukuzawa entitled "Development of a Mechanical Refrigerator for Geothermal Well Logging Sonde Electronics", described in a U.S. Department of Energy publication on Geothermal Energy #SAN/1380-1, January 1978, page 38. The compressor system described in U.S. Pat. No. 3,435,629 employs vaporization of a stored working fluid (water), wherein the vapor is compressed and transferred to an auxiliary high pressure chamber. On the other hand, the system described in the publication employs a complete self-contained, downhole, closed loop, mechanical refrigeration unit wherein the working fluid (water) is compressed, condensed, evaporated, and recycled using a classical Rankine refrigerator design technique. The primary problem involved with both of these two active thermal protection techniques is the requirement for a downhole prime mover (motor) and compressor which must operate at the high temperature. The system described in the above noted patent is also time limited by the amount of working fluid stored in the sonde. Besides the short operating time limit for the passive thermal protection systems and developability problems for the active systems described, current well logging electromechanical and optomechanical cables cannot function in hostile high temperature and pressure fluidic wells above about 260 degrees centigrade.

Conventional hostile high temperature environment electromechanical well logging cables incorporate polymer materials for jacketing and insulation such as Teflon fluorocarbon resins developed and patented by E. I. DuPont de Nemours and Company, Inc. Teflon is the best know high temperature electrical insulation material that is hydrolytically stable. It is rated by its manufacturer at a maximum continuous service temperature of 260 degrees centigrade. The use of optical wave guide fibers (fiber optics) has been explored as a possible solution because it was assumed that glass fibers would be highly resistant to the hostile geothermal environment. However, the problems with fiber optic mechanical cables are very similar to the problems with electromechanical cables, i.e., some type of hydrolytically stable, high temperature and pressure resistant coating must be incorporated to buffer/protect the fiber. While several novel techniques for protecting, containing and/or supporting one or more tubes or communication channels by use of a wire braid and/or corregated interlocking metal sheath around them (see U.S. Pat. Nos. 2,416,561; 2,578,280; 3,538,238; 3,603,718 and 3,603,719), none of the above patents describe techniques that solve the problem for a long length (> 1,000 feet) of well logging cable for use in a high temperature and pressure environments by use of a wire rope as the axial strength member having a small diameter impervious metal tube(s) in the core for communication channels. The diameter and wall thickness of the metal tube(s) in the wire rope core must be primarily sized to (1) minimize the elongation due to bending over sheaves and applied tension loads at the wellhead, and (2) to withstand the high stresses exerted by high pressures and temperatures within the wall.

To overcome these time and temperature limitations requires the use of higher temperature materials (electronics, insulation, motors, etc.) and/or better thermal protection systems. Also, cable communications logging systems will require development for extreme hostile well environments. The present invention overcomes all of these limitations and thereby effectively advances the field of geothermal and fossile energy development requiring downhole well measurements in high temperature and pressure hostile environments.

SUMMARY OF THE INVENTION

In view of the foregoing factors and conditions characteristic of the prior art, it is a primary object of the present invention to provide an improved well logging thermal protection system.

Another object of the present invention is to provide a simple yet very effective and reliable evaporative thermal protection system for maintaining a payload, located in a sonde, at a desired cooler temperature than that of the downhole environment.

Still another object of the present invention is to provide a thermal protection system including a sonde-located thermal protection cartridge carrying either an active evaporization system or a passive evaporization system for maintaining a payload at a desired temperature.

In accordance with an embodiment of the present invention, an evaporative thermal protection system for use in hostile environment well logging applications including a sonde, is provided for maintaining a payload located within the sonde at a desired temperature cooler than that of the downhole environment. The system includes an evaporative thermal exhaust apparatus disposed within a sonde-located downhole thermal insulation cartridge. The evaporative thermal exhaust apparatus includes a vaporizing working fluid and an exhaust port through which the vaporized working fluid may flow. The invention also includes a hostile environment flexible fluidic communication mechanical cable including at least one metal tube operatively coupled to the exhaust port and exhausting to the surface the vaporized working fluid.

The cartridge may include an active expansion and evaporization refrigeration system supplied with the high pressure working fluid from (1) uphole through a second metal tube in the core of the cable or (2) a self contained high pressure supply of working fluid or (3) if water is used as the working fluid and water is the well fluid, from the high pressure well itself; or the cartridge may include a passive evaporization system having low pressure working fluid stored in the cartridge which evaporates and exhausts preferably through a pressure regulator valve through the exhaust port and the tube in the cable.

The features of the present invention which are believed to be novel are set forth with particularity in the appended claims. The present invention, both as to its organization and manner of operation, together with further objects and advantages thereof may best be understood by making reference to the following description taken in conjunction with the accompanying drawings in which like reference characters refer to like elements in the several views.

DESCRIPTION OF THE PREFERRED EMBODIMENTS

Figure 1:
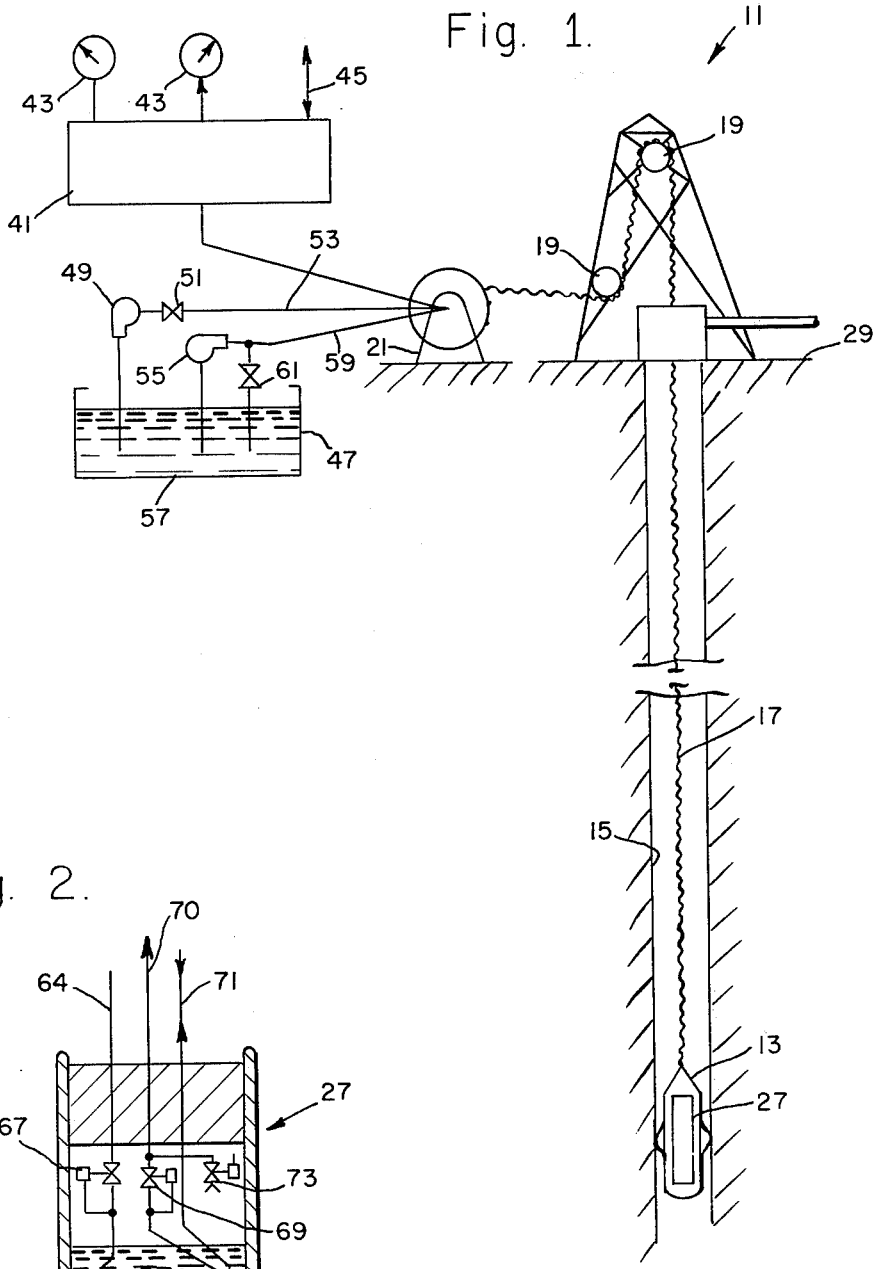
FIG. 1 is a diagrammatic representation of a well logging system incorporating the evaporative thermal protection system according to the present invention.
Figure 2:
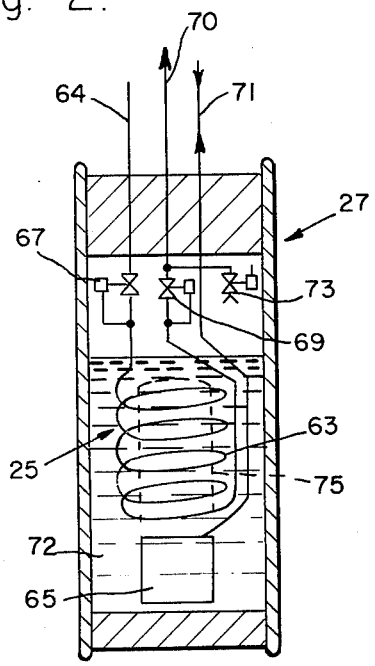
FIG. 2 is a sectional view of a downhole thermal protection cartridge housing a active evaporation system in accordance with the invention.

Referring now to the drawings and more particularly to FIGS. 1 and 2, there is shown an evaporative thermal protection system 11 for use in hostile environment well logging applications. The system includes an instrument package 13, generally known as a well logging sonde, which is lowered into a borehole 15 on a hostile environment flexible communications mechanical cable 17. The cable is movably supported on conventional pole-mounted sheaves 19 and is lowered and raised by a conventional cable drum winch unit 21 at a convenient surface location.

Figure 4:
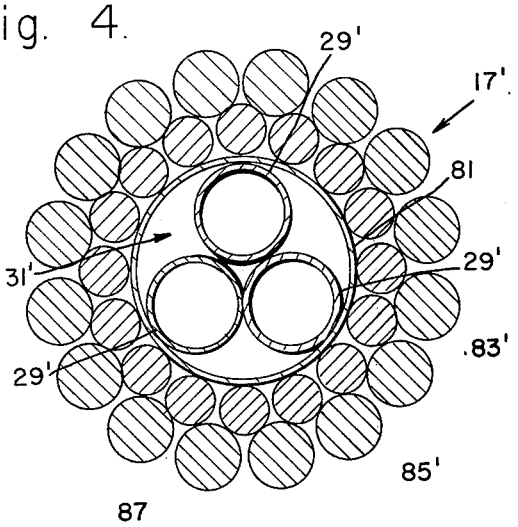
FIG. 4 is an enlarged cross sectional view of the cable constructed in accordance with another embodiment of the invention.
Figure 3:
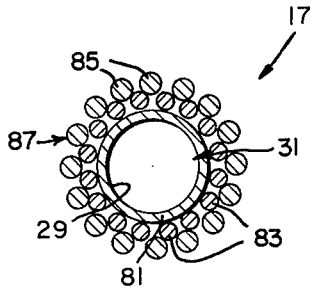
FIG. 3 is an enlarged cross sectional view of the hostile environment flexible mechanical cable constructed in accordance with an embodiment of the invention.

The cable 17 is multi-functional and must not only have strength to support the sonde in deep well environments but must also provide working fluid exhaust communications to the surface from an evaporative thermal exhaust apparatus 25 located in a sonde-mounted downhole thermal insulation cartridge 27. Preferably, the cable is a contrahelically wound wire rope having one or more metal tubes 29 in its core 31, as seen in FIGS. 3 and 4 for example. At least one of the tubes 29 is used as the working fluid exhaust conduit to the well surface, while another tube or tubes may supply working fluid to an active evaporative thermal exhaust apparatus 25 as shown in FIG. 2.

Still in another embodiment of the invention, the tubes not used for supplying and/or exhausting the working fluid may be used to provide channels for electrical and/or optical conductors for measurement and control at the surface. For example, there may be located at the surface a conventional signal processing and conditioning unit 41 having meters 43 and command and control actuators represented by the arrows 45. A working fluid supply/storage tank 47 is also located uphole and may include a vacuum exhaust pump 49 and a valve 51 to control the pressure in the exhaust line 53 which communicates with one of the cable tubes 29. The pump 49 is optional and allows operation at lower downhole exhaust pressures and accompanying temperatures. In the embodiment of FIG. 2, a working fluid supply pump 55 pulls a working fluid such as water 57 from the tank 47 or other source and forces it through a supply line 59 and one of the tubes 29' in the cable 17 to the active evaporative thermal exhaust apparatus 25. A conventional bypass valve 61 or other device may be provided to regulate the flow of the working fluid to the downhole refrigeration unit.

Again referring to the embodiment of FIG. 2, the apparatus 25 includes a tubular evaporator portion 63 spirally wound and adjacent or around a payload 65 and heat sink material 75. Working fluid forced down a supply line 64 (one of the tubes 29'), flows through the evaporator 63 after passing through a conventional expansion valve/regulator 67 that senses the downstream pressure in order to maintain evaporator pressure at a desired level. Upon expansion, the primary working fluid is vaporized and lowered in temperature in the evaporator 63 where it absorbes heat from the payload and heat sink and exhausts the heat to the well surface through an exhaust pressure control regulator 69 which opens when there is enough pressure at that point to ensure that the exhausting fluid will flow to the top of the well, through the cable on the winch and out the end even when there is condensation in the return or exhaust tube 70 due to lower temperatures along the tube above the sonde. Of course, where there is no substantial temperature gradient along the exhaust line or tube, such as in a 'hot flowing well' situation, this regulator would not be needed.

The payload 65 may be of any conventional type employed in well logging tools, and it may include electrical and/or pneumatic and/or optical communications lines 71 to the surface. Alternately, the payload may be totally self contained and not accessed until retrieved at the surface, in which case, no communications line other than working fluid supply and/or exhaust are required.

This embodiment of the invention also includes a passive working fluid 72, such as water, disposed in the insulation cartridge 27 and surrounding the evaporator 63 and the payload 65. This fluid is not essential to the operation of the system, but has the advantage of providing efficient distribution of heat between the payload and the evaporator. Also, in the case of a failure of the primary cooling system (active refrigerator) by, for example, a primary working fluid supply pump failure 55, the secondary working fluid 72 would evaporate and exhaust through a secondary exhaust pressure regulator 73 to the exhaust tube 70. This will provide additional time to recover the sonde 13 and lessen the possiblity of damage to the payload by elevated temperatures. Further, a non-volatile mass or heat sink 75 may be disposed within the cartridge 27 for the same purpose. This technique is well known in the art and will not be described here in detail.

In active operation, the primary working fluid 57, obtained from the tank 47 or, if water, directly from a main water supply pipe or other convenient source, is in high pressure liquid form at well temperature and is expanded through the pressure regulator 67 to a low pressure into the evaporator 63 to lower the temperature to that of saturated vapor at design pressure and temperature which in so doing absorbs and removes heat from the thermal heat sink 75 and/or the payload 65. The vapor is then exhausted through the long exhaust tube 70 to the surface area 30. The exhaust tube is at well temperature and rapidly heats the exhausting vapor to a superheated temperature such that the temperatures in the intake and exhaust lines directly above the insulated cartridge 27 are about the same, and the pressure in the exhaust line directly above the cartridge is approximately the same as the pressure in the evaporator 63 when the pressure control regulator 69 is open. The superheated vapor moves up the well within the tube wherein it is maintained near the well temperature. For some well temperature profiles, condensing conditions may occur prior to reaching the top mast pole sheave. However, the flowing exhaust conditions are designed to maintain the exhaust flow out the cable end. Prior to exhausting at the cable end, condensing will typically occur within the cable on the winch, whereby the exhaust fluid will be in a liquid phase as it exits into the supply tank.

In accordance with yet another embodiment of the present invention, the cable 17 or 17' includes one or more metal tubes 29 which form the cable's central core 31. Preferably, the tube or tubes 29 are wrapped by a helically wound stiff wire, metal tape or band 81 to serve as a bedding for the wire strands 83,85 of a contrahelically wound wire rope 87 of the cable. Where more than one tube is used, as shown in FIG. 4 for example, the tubes are preferably helically twisted together. The wire rope 87 acts as armor to provide abrasian protection and to carry most of the cable's load to permit the use of flexible tubes having very small diameters. Thus, it can be seen that the corrosion and pressure resistant metal tubes 29 form a hermetic block to the fluidic environment of the well. It has been determined that an OD under 3/16 inch of this cable care has enough flexibility to permit construction of a cable compatible with practical winch and sheave diameters. Construction of such wire rope tube-carrying cable 15,000 feet or more in length can be achieved using existing tube and wire rope manufacturing technologies. Further, small, all metal pressure regulator valves for expansion control and exhaust pressure control which can reliably operate at the temperatures and pressures required, have been developed.

In addition to solving the high temperature insulation problems, the metal tubing also provides a convenient interface with the cable head/sonde which can actually be welded in place to the cable head or incorporate a swage tube fitting to form an excellent high temperature/pressure seal.

Figure 5:
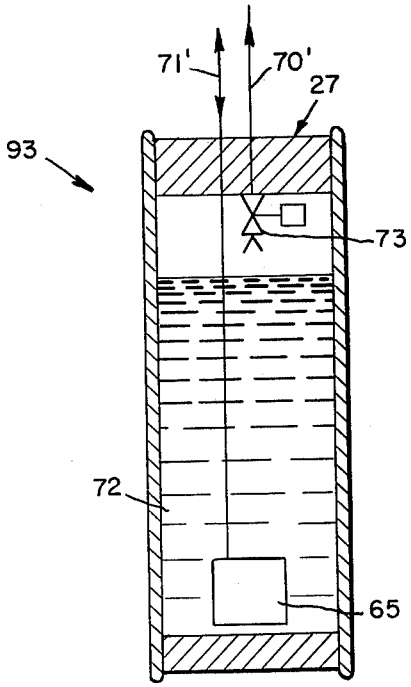
FIG. 5 is a sectional view of a downhole thermal insulation cartridge housing a passive evaporation system in accordance with still another embodiment of the present invention.

Referring now to the passive evaporation system 93 illustrated schematically in FIG. 5, it can be seen that the cartridge 27' contains the passive working fluid 72 which surrounds the payload 65 and which exhausts, as in the embodiment of FIG. 2, through the regulator valve 73 to the surface through the exhaust tube 70. This system may also include a non-volatile heat sink mass, and the payload may or may not include a communication link to the surface.

From the foregoing, it can be seen that there has herein been described a highly advantageous well logging evaporative thermal protection system including a downhole evaporative thermal protection cartridge disposed within a well logging sonde or tool to keep a payload such as sensors and support electronics cool, the cartridge carrying either an active evaporative system for refrigeration or a passive evaporative system, both exhausting to the surface, preferably through an armored flexible fluidic communication mechanical cable.

It should be understood that the materials used to fabricate the various embodiments of the invention are presently available and any material exhibiting similar desired characteristics may be substituted for any material mentioned. For example, it should be understood that although water is specifically identified as a presently preferred working fluid, other liquids with similar high temperature thermodynamic characteristics may be utilized in the invention.

The systems described herein are designed to maintain the payload at below a maximum temperature for a given heat load, i.e., payload heat dissapation plus heat transfer through the dewar/cartridge 27. Analysis and design have been performed to establish operation of these systems at payload temperatures and heat loads within practical limits maintaining payload temperatures at less than 190 degrees centigrade and with heat loads of about 150 Btu/hour in a 14,000 foot deep well with well temperatures ranging from 250 to about 375 degrees centigrade and with exhaust tube OD's of less than 0.15 inch (ID less than $\frac{1}{8}$ inch).

Although the present invention has been shown and described with reference to particular embodiments, nevertheless, various changes and modifications which are obvious to persons skilled in the art to which the invention pertains are deemed to lie within the spirit, scope and contemplation of the invention.

What is claimed is:

1. An evaporative thermal protection system for use in hostile environment well logging applications and including a sonde, for maintaining a payload located within the sonde at a desired cooler temperature than that of the downhole environment, the system comprising:

a downhole thermal insulation cartridge disposed within a sonde;

an evaporative thermal exhaust apparatus disposed within said cartridge and including a vaporizing working fluid and an exhaust port through which vaporized working fluid may flow; and a hostile environment flexible fluidic communication mechanical cable including at least one tube operatively coupled to said exhaust port and exhausting to the surface said vaporized working fluid.

2. The evaporative thermal protection system according to claim 1, wherein said evaporative thermal exhaust apparatus is an active expansion and evaporization refrigeration system, wherein said cable also includes a supply tube communicating with said active refrigeration system, and wherein said working fluid is supplied to said active refrigeration system under pressure.

3. The evaporative thermal protection system according to claim 2, wherein said active expansion and evaporization refrigeration system includes a tubular evaporator portion and valve means disposed in said cartridge in series with said supply tube for maintaining the working fluid pressure and associated temperature in said evaporator portion at in said evaporator portion at desired levels.

4. The evaporative thermal protection system according to claim 3, wherein said evaporator portion is in a spiral configuration adjacent said payload.

5. The evaporative thermal protection system according to claim 1, wherein said evaporative thermal exhaust apparatus includes an exhaust pressure control regulator means disposed in said cartridge for regulating the exhausting of said vaporized working fluid to ensure that said exhausting fluid will flow to the top of the well through and out of said cable.

6. The evaporative thermal protection system according to claim 1, wherein said cable also includes at least one additional tube as a conduit for signal data communications between the well surface and said payload.

7. The evaporative thermal protection system according to claim 1, wherein said evaporative thermal exhaust apparatus includes an additional working fluid within said cartridge adjacent said payload, said additional working fluid not being in communication with any supply of working fluid.

8. The evaporative thermal protection system according to claim 7, wherein said additional working fluid is a secondary working fluid providing distribution of heat between said payload and said evaporator portion.

9. The evaporative thermal protection system according to claim 1, wherein said cartridge also includes a passive exhaust pressure regulator valve means communicating with said exhaust tube for exhausting to said exhaust tube when said passive exhaust pressure regulator valve is open.

10. The evaporative thermal projection system according to claim 1, wherein said evaporative thermal exhaust apparatus is a passive system including a passive working fluid disposed in said cartridge, said passive working fluid not being under external pressure and not in communication with any supply of working fluid.

11. In an evaporative thermal protection system for use in hostile environment well logging applications and including a sonde, for maintaining a payload located within the sonde at a desired cooler temperature than that of the downhole environment, a hostile environment flexible fluidic communication mechanical cable, comprising:

a corrosion and pressure resistant metal tube forming a central cable core, said metal tube having an outside diameter less than 3/16 inch; and a contrahelically wound multi-stranded high strength, corrosion resistant metal wire rope disposed about said metal tube and providing abrasion protection and carrying most of the cable's load.

12. The hostile environment flexible fluidic communication mechanical cable according to claim 11, also comprising more than one metal tube in said core of said wire rope to serve as additional communication channels between the sonde and the surface.

* * * * *